US007293435B2

(12) United States Patent
Elexpuru et al.

(10) Patent No.: US 7,293,435 B2
(45) Date of Patent: Nov. 13, 2007

(54) HYDRAULIC DISTRIBUTOR FOR A WASHING MACHINE

(75) Inventors: Anton Elexpuru, Mondragon (ES); Jon Arregi, Antzuola (ES)

(73) Assignee: Fagor, S. Coop., Mondragon (ES)

( * ) Notice: Subject to any disclaimer, the term of this patent is extended or adjusted under 35 U.S.C. 154(b) by 626 days.

(21) Appl. No.: 10/806,892

(22) Filed: Mar. 22, 2004

(65) Prior Publication Data

US 2004/0244437 A1 Dec. 9, 2004

(30) Foreign Application Priority Data

Apr. 16, 2003 (ES) ..... 200300945

(51) Int. Cl.
*D06F 39/02* (2006.01)
*D06F 29/00* (2006.01)

(52) U.S. Cl. ..... 68/12.18; 68/17 R; 137/601.21; 137/601.16; 137/876

(58) Field of Classification Search ..... 222/494, 222/410; 137/601.21, 601.16, 876
See application file for complete search history.

(56) References Cited

U.S. PATENT DOCUMENTS 3,567,076 A * 3/1971 Zanussi ..... 222/144
4,753,570 A * 6/1988 Jarvis ..... 415/146
5,791,168 A * 8/1998 Smock et al. ..... 68/12.18

* cited by examiner

*Primary Examiner*—Michael Barr
*Assistant Examiner*—Jason P. Riggleman
(74) *Attorney, Agent, or Firm*—The Kline Law Firm

(57) ABSTRACT

A hydraulic distributor for a washing machine which comprises a rotating axle (7), water being directed from the mains to a plurality of compartments of the washing machine by means of the rotation of said rotating axle (7); a hydraulic body (2) which comprises an emptying pipe (10), a draining pipe (11) and an exit pipe (15) for re-circulation; and a valve body (6) housed inside said hydraulic body (2). By means of the rotation of the rotating axle (7) the valve body (6) can have a first position, in which the flow from the emptying pipe (10) is directed to the draining pipe (11), and a second position, in which the flow from the emptying pipe (10) is directed to the exit pipe (15) for re-circulation.

18 Claims, 9 Drawing Sheets

HYDRAULIC DISTRIBUTOR FOR A WASHING MACHINE

TECHNICAL FIELD

The present invention relates to hydraulic distributors for electrical appliances such as washing machines.

PRIOR ART

In washing machines, it is essential to control the entry of water from the mains to different compartments of the washing machine tray (pre-wash, wash, fabric softener, bleach, etc.). To do so, separate electrovalves for each compartment, a combination of electrovalves or indeed a single electrovalve with mechanisms for guiding the entry of water can be used.

Washing machines are known in which the movement of an electromechanical programmer acts on an actuating mechanism, which successively activates the flow of water to the different compartments. Washing machines are also known which use an electronic programmer, which drives a guiding mechanism analogous to that of washing machines with an electromechanical programmer using, for example, a micromotor.

Washing machines also have a draining function, connecting an emptying pipe to a draining pipe to empty the waste water. Washing machines are known which include a motor pump for this purpose.

Another function that washing machines may include is the re-circulation function, whereby the water is re-circulated from the emptying pipe to the washing machine drum during the washing cycles. Washing machines are known which include a second motor pump for carrying out this function and other washing machines are known which use a single motor pump for draining and re-circulating.

EP 1029965 A1 discloses a hydraulic distributor which comprises a rotating body suitable for selectively distributing the water from an inlet pipe to a plurality of exit pipes connected to the compartments of the tray of the washing machine. Said rotating body turns by motorized means.

Together with the hydraulic distributor, there is a re-circulation unit which comprises a casing with an emptying pipe, a draining pipe and a re-circulation pipe, and also includes a pivoting flap which can seal off the draining pipe or the re-circulation pipe. The flap is moved by the motorized means via intermediate elements that include a lever.

DISCLOSURE OF THE INVENTION

The main object of the invention is to provide a compact hydraulic distributor with a simple configuration for managing the transmission of water from the mains to the compartments of a washing machine tray and for managing draining and re-circulation.

The hydraulic distributor of the invention comprises a rotating axle which, with its rotation, directs water from the mains to a plurality of compartments of the washing machine tray, a hydraulic body which comprises an emptying pipe, a draining pipe and an exit pipe for re-circulation, and a valve body housed inside said hydraulic body.

The valve body turns together with the rotating axle. And thus, by the turning action of the rotating axle, as well as directing the water to the different compartments of the washing machine tray, the valve body can also have a first position, in which the flow from the emptying pipe is directed to the draining pipe, and a second position, in which the flow from the emptying pipe is directed to the exit pipe for re-circulation.

The use of the hydraulic distributor of the invention permits dispensing with the need to use specific devices for draining and re-circulation, as well as the use of more than one electrovalve or more than one motor pump. In this way, the structure and system for connecting the washing machine are simplified, making assembly of the washing machine quicker, and also making significant savings in terms of cost.

In addition, the fact that the draining and re-circulation mechanism is integrated within the hydraulic body makes the distributor of the invention compact, robust and easy to assemble.

Other objects, characteristics and advantages will become clear upon viewing the figures and the detailed description of the invention.

DETAILED DISCLOSURE OF THE INVENTION

Figure 1:
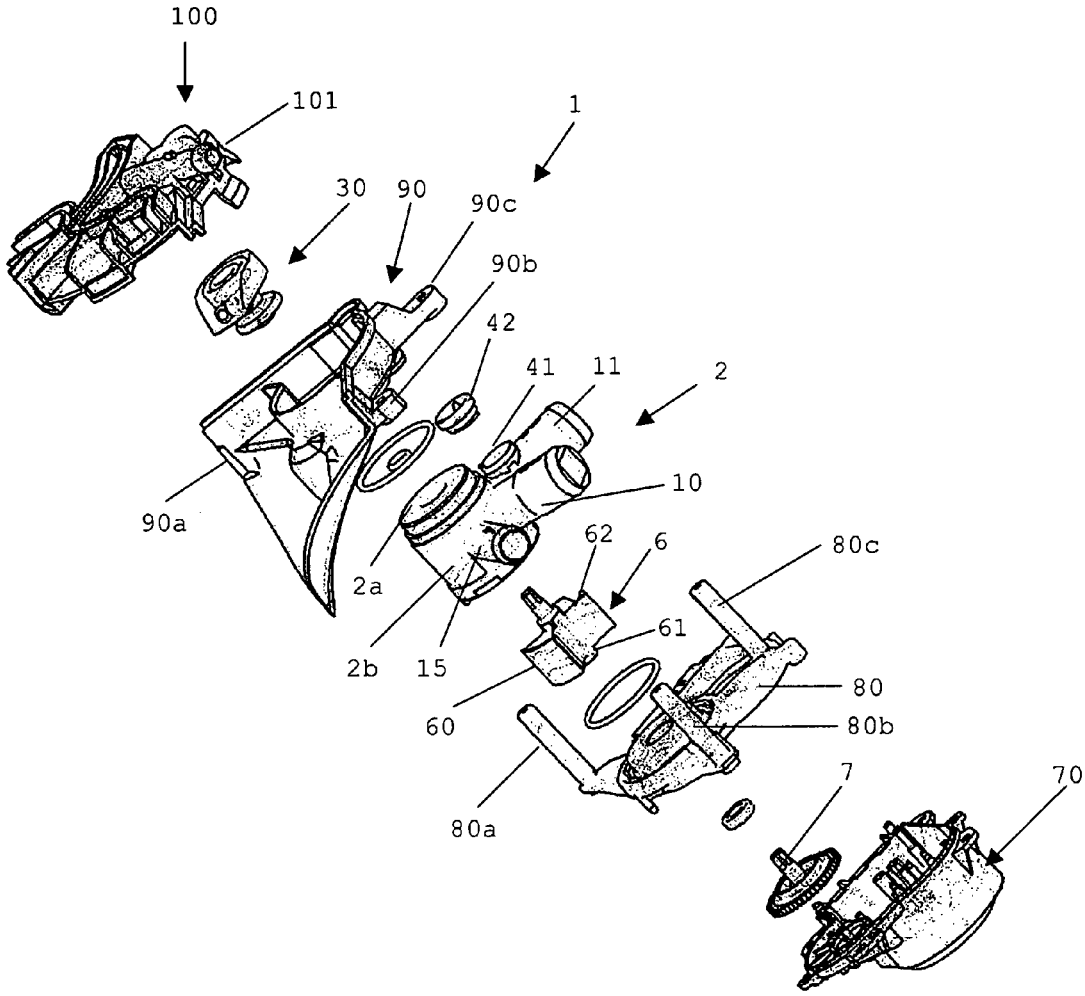
FIG. 1 is an exploded view of an embodiment of the hydraulic distributor of the invention.
Figure 2:
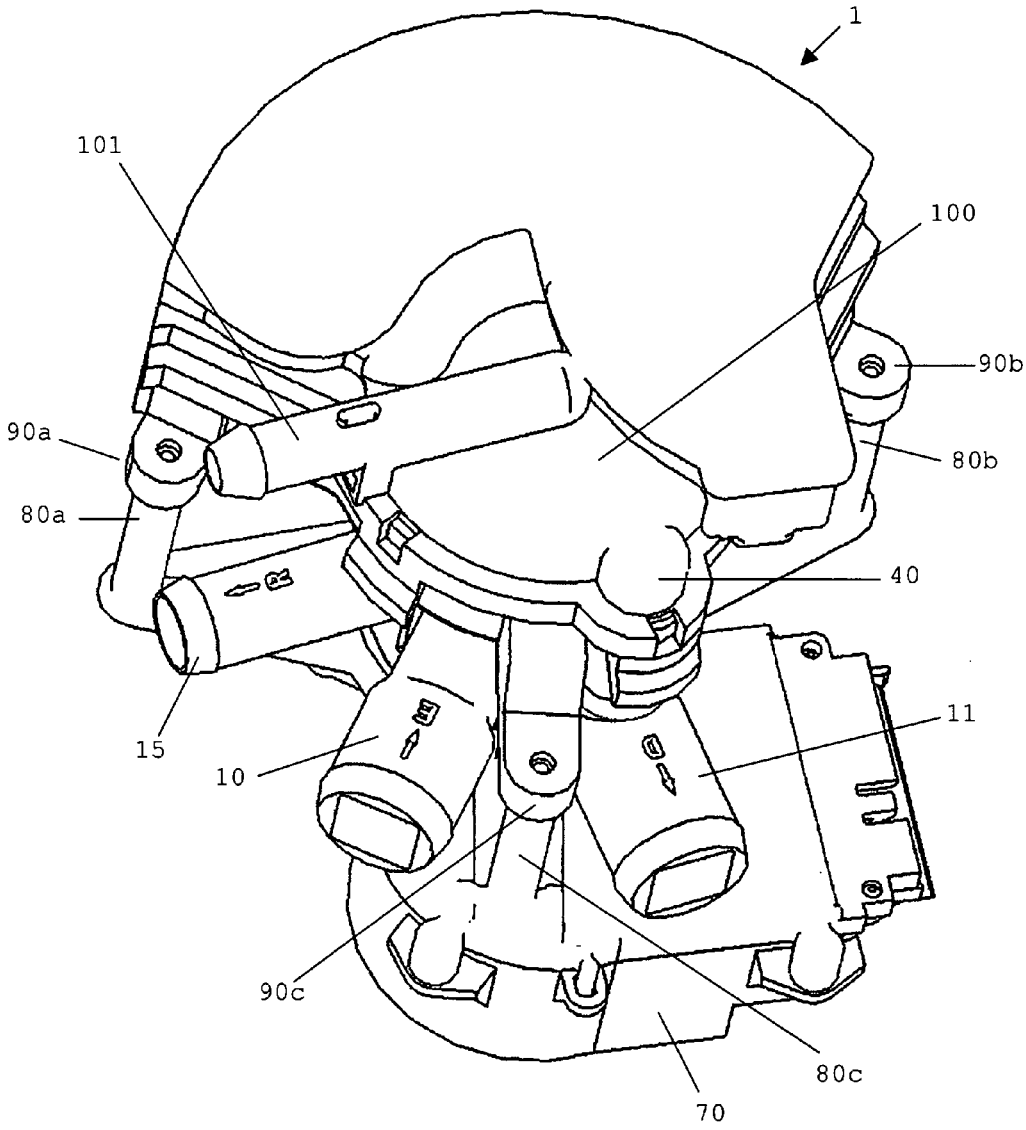
FIG. 2 is a perspective view of the embodiment of FIG. 1.
Figure 3:
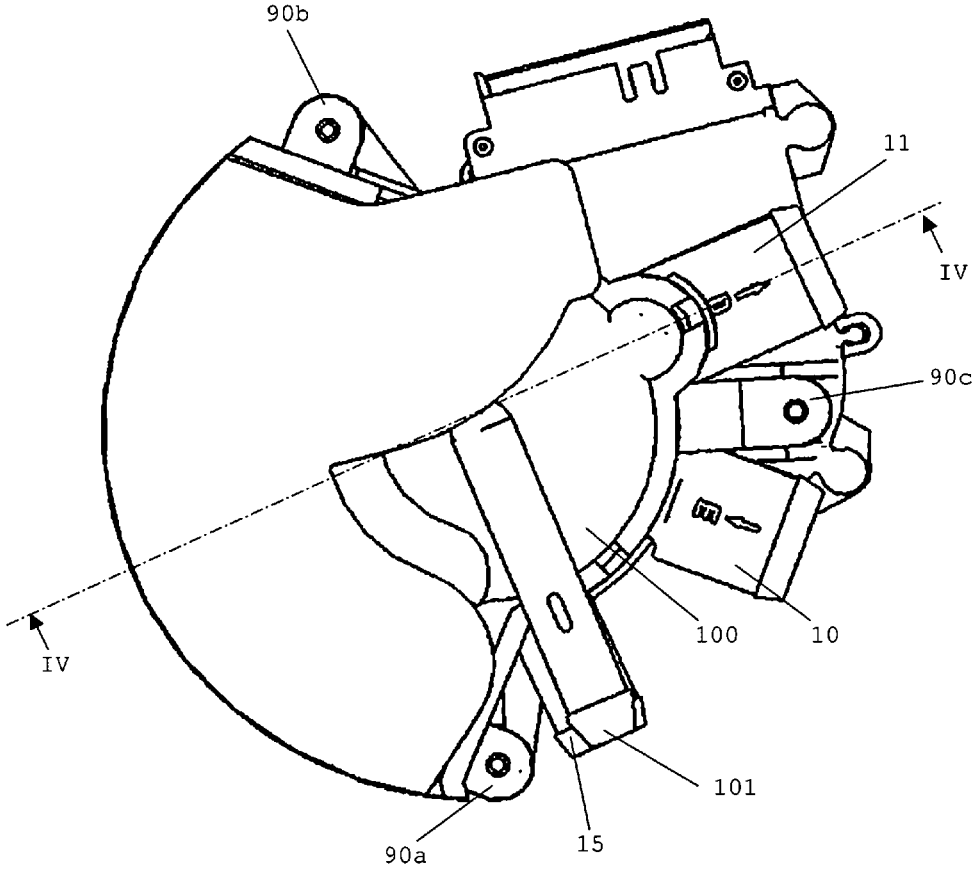
FIG. 3 is a ground view of the embodiment of FIG. 1.
Figure 4A:
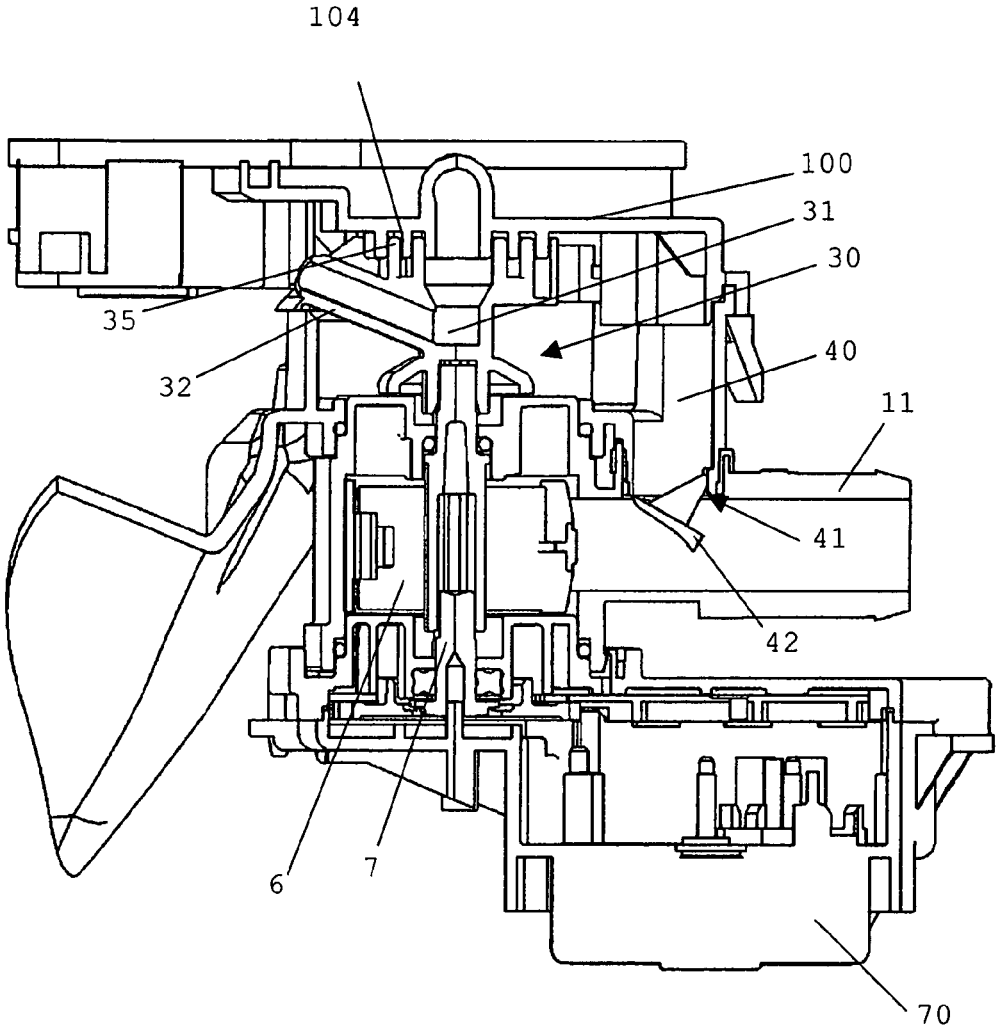
FIG. 4A is a view according to the section IV-IV shown in FIG. 3, with the valve body in a first position.
Figure 4B:
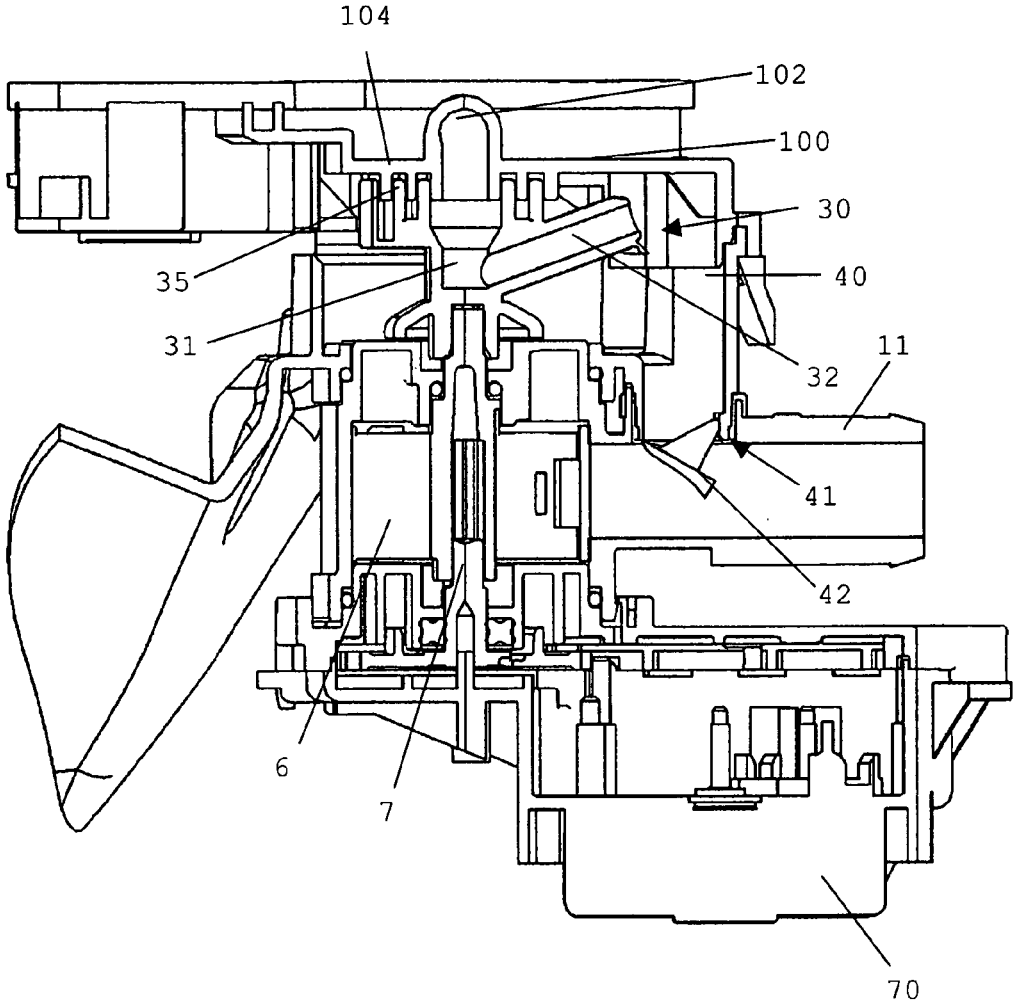
FIG. 4B is a view according to the section IV-IV shown in FIG. 3, with the valve body in a second position.

With reference to FIG. 1, the hydraulic distributor 1 of the invention comprises:

- a rotating axle 7 which, with its rotation, directs the water from the mains to a plurality of compartments (not shown in the figures) of the washing machine;
- a hydraulic body 2 which comprises an emptying pipe 10, a draining pipe 11 and an exit pipe 15 for re-circulation; and
- a valve body 6 housed inside said hydraulic body 2.

The rotating axle 7 is turned by a motor (not shown in the figures) which is housed in a lower casing 70 and is connected to the rotating axle 7 by gearing means. The casing 70 is fixed to a base body 80 onto which the hydraulic body 2 is clipped.

The rotating axle 7 is attached to the valve body 6. And thus, via the turning of the rotating axle 7, the valve body 6 can have a first position, in which the flow from the emptying pipe 10 is directed to the draining pipe 11, and a second position, in which the flow from the emptying pipe 10 is directed to an exit pipe 15 for re-circulation. The water that reaches the hydraulic body 2 from the emptying pipe 10 by the action of an emptying pump (not shown in the figures), is thus directed either to the draining pipe 11, or to the exit pipe 15 for re-circulation.

Figure 5A:
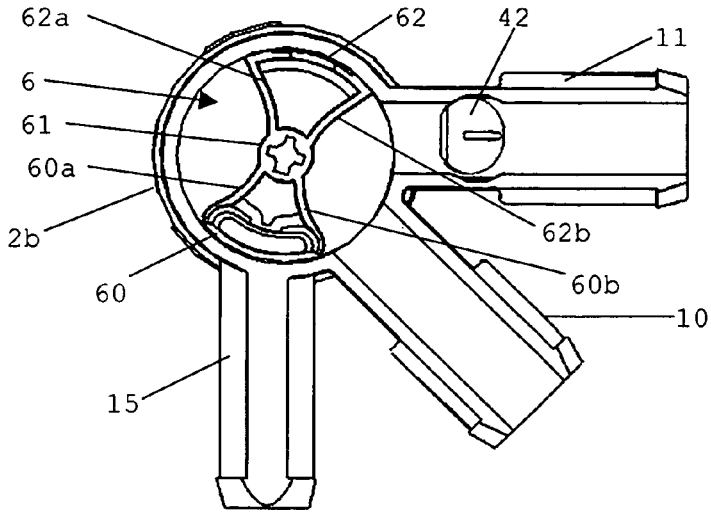
FIG. 5A shows a cross-sectional elevation of the hydraulic body and the valve body of the embodiment in FIG. 1, said valve body being in a first position.
Figure 6A:
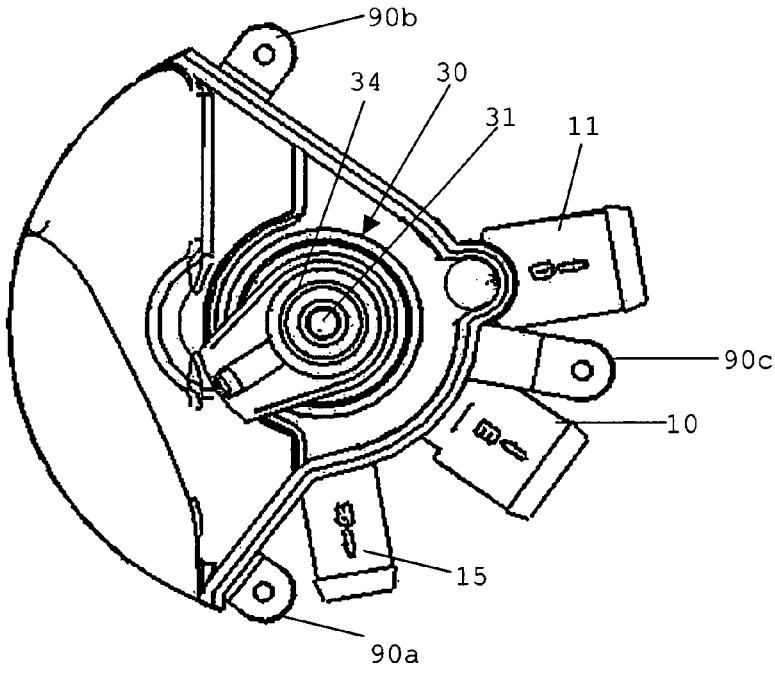
FIG. 6A is a ground view of the embodiment in FIG. 1, in which the upper casing has been removed, the valve body being in a first position.
Figure 5B:
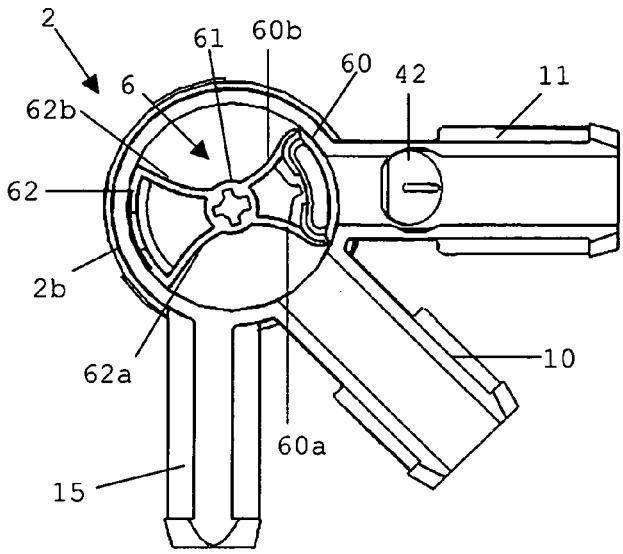
FIG. 5B shows a cross-sectional elevation of the hydraulic body and the valve body of the embodiment in FIG. 1, said valve body being in a second position.
Figure 6B:
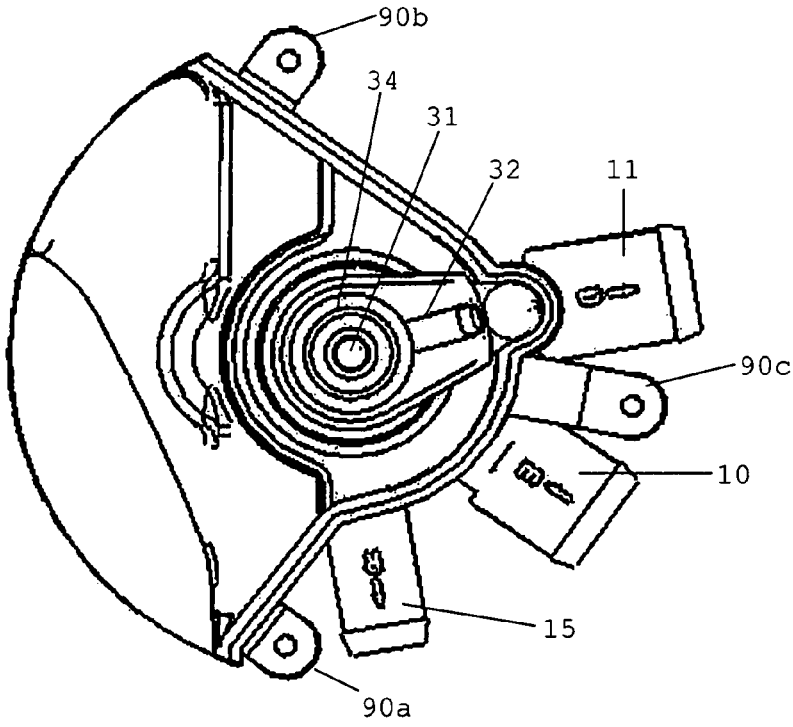
FIG. 6B is a ground view of the embodiment in FIG. 1, in which the upper casing has been removed, the valve body being in a second position.

The valve body 6 comprises a wall 60 which seals off the exit pipe 15 for re-circulation when said valve body 6 is in the first position, as shown in FIG. 5A, and which seals off the draining pipe 11 when said valve body 6 is in the second position, as shown in FIG. 5B.

As can be seen in FIG. 1, the hydraulic body 2 comprises a profile 2*b* which is substantially cylindrical and coaxial with the rotating axle 7, and it also comprises an upper surface 2*a*. The emptying pipe 10 and the exit pipe 15 are joined to said profile 2*b* and, as can be seen in FIGS. 5A and 5B, the wall 60 of the valve body 6 rests on the inner surface of said profile 2*b*.

Figure 7:
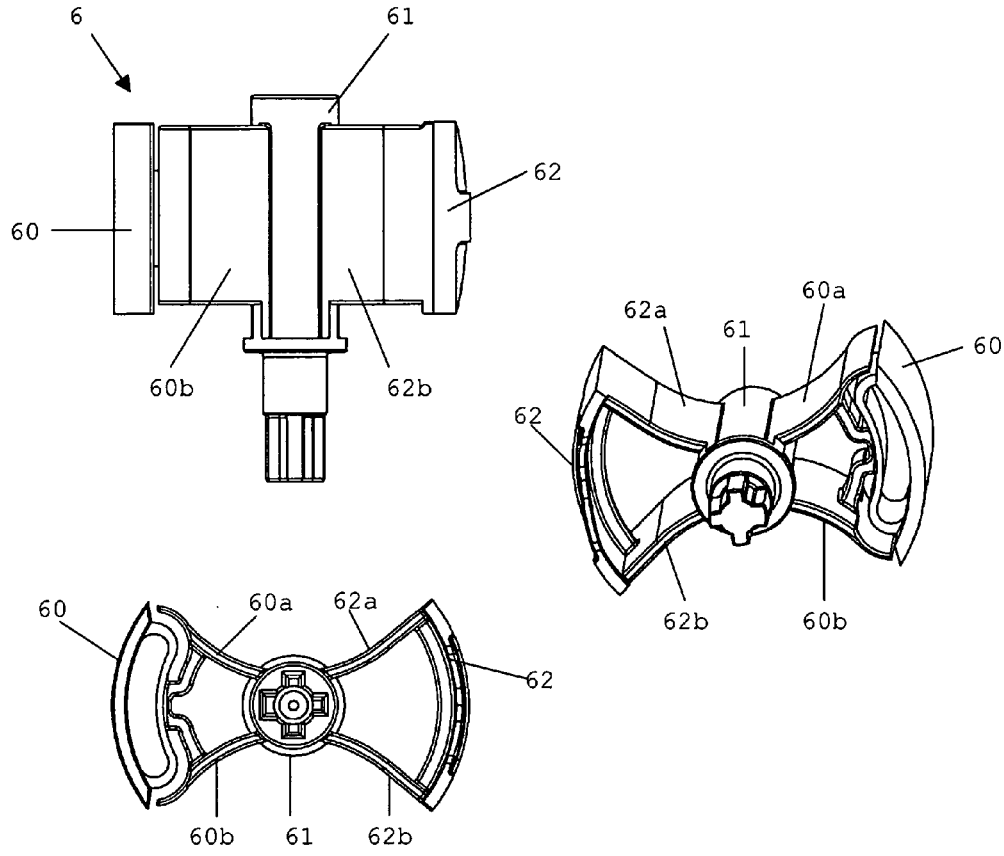
FIG. 7 shows an embodiment of the valve body of the hydraulic distributor of the invention.

The valve body 6, shown in detail in FIG. 7, comprises a bushing 61 which is attached to the rotating axle 7, said bushing 61 being joined to the wall 60 by means of ribs 60*a* and 60*b*. Said valve body 6 also comprises a wall 62, which is not a sealing wall, positioned symmetrically to the wall 60 with respect to the bushing 61. Said bushing 61 is joined to said wall 62 by means of ribs 62*a* and 62*b*.

The wall 60 of the valve body 6 is flexible, whereby said wall 60 fits to the inner surface of the profile 2*b* of the hydraulic body 2, obtaining the best possible seal on the exit pipe 15 for re-circulation or on the draining pipe 11. The wall 62 also rests on the inner surface of the profile 2*b* of the hydraulic body 2. By means of said wall 62, the valve body 6 can be centred on the inside of the hydraulic body 2 at any time, thus preventing, for example, the pipes 15 and 11 from being sealed incorrectly, due to any gap between the bushing 61 and the rotating axle 7.

The wall 62 is not a sealing wall, it allows the water to pass through even though it is facing the pipe 15 or 11. In the embodiment shown in FIG. 7, said wall 62 is H-shaped. Furthermore, the ribs 60*a* and 62*a* direct the water from the emptying pipe 10 to the exit pipe 15 when the valve body 6 is in the re-circulation position and, in the same way, the ribs 60*b* and 62*b* direct the water from the emptying pipe 10 to the draining pipe 11 when the valve body 6 is in the emptying position.

The hydraulic distributor 1 of the invention also comprises a distribution nozzle 30 which turns together with the rotating axle 7, said distribution nozzle 30 transmitting the water coming from the mains to the corresponding washing machine compartment depending on its angular position. As can be deduced from FIG. 1, said distribution nozzle 30 is attached to the valve body 6.

The distribution nozzle 30 is on a cup-shaped part 90 which is joined to the upper surface 2*a* of the hydraulic body 2. The hydraulic body 2 is fixed between the base body 80 and the cup-shaped part 90. The base body 80 comprises three rods 80*a*, 80*b* and 80*c* which are fixed respectively to three projections 90*a*, 90*b* and 90*c* of the cup-shaped part 90. Lastly, there is an upper casing 100 on said cup-shaped part 90. Said upper casing 100 comprises an inlet pipe 101 from which the water from the mains is transmitted to the distribution nozzle 30.

The hydraulic distributor 1 of the invention therefore has a compact, modular configuration. Said hydraulic distributor 1 could also be used in washing machines that do not have a re-circulation system, simply by dispensing with the elements used for said re-circulation.

To prevent water from overflowing due to a possible failure as, for example, the breakdown of the electrovalve through which the mains water enters, or a failure in the control electronics of the washing machine itself, the washing machines comprise an overflow safety level detector whereby, if said safety level is exceeded, the emptying pump is activated, draining off the water through the draining pipe.

If a hydraulic distributor is positioned between the emptying pump and the draining pipe, when said hydraulic distributor is in the re-circulating position, the safety against the cited failures disappears, and the double failure security required by the homologation standards in force is not fulfilled.

This problem is resolved by the hydraulic distributor 1 of the invention, since, when the wall 60 of the valve body 6 seals off the draining pipe 11, the distribution nozzle 30 is positioned such that said distribution nozzle 30 would transmit any water coming from the mains to the draining pipe 11. In this way, as the valve body 6 and the distribution nozzle 30 turn together at all times, even though other elements of the washing machine might fail, any excess water entering it will always make its way to the draining pipe 11.

More specifically, in the embodiment described, when the wall 60 of the valve body 6 seals off the draining pipe 11, the distribution nozzle 30 points towards an area 40 with a hole 41 in its lower part whereby it connects to the draining pipe 11. In said hole 41 there is a valve 42 which seals the hole 41 when there is a flow of water through the draining pipe 11 from the hydraulic body 2. This therefore prevents water from passing through said hole 41 when the water crosses the draining pipe 11.

In this embodiment, the valve 42 comprises a flap 43 which pivots with respect to the edge of the hole 41 which is closest to the hydraulic body 2 so that, when there is a flow of water through the draining pipe 11 from said hydraulic body 2, said flow pushes said flap 43, making said flap 42 seal the hole 41. Instead of a valve with these characteristics, a ball valve, for example, could also be used.

The distribution nozzle 30 comprises a central water inlet pipe 31 coaxial with the rotating axle 7 and a water outlet pipe 32 which extends radially from said central pipe 31.

Figure 8:
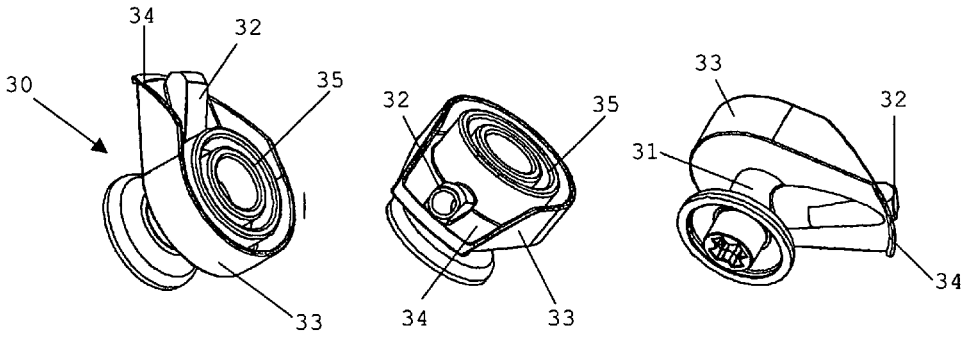
FIG. 8 shows a first embodiment of the distribution nozzle of the hydraulic distributor of the invention.

In a first embodiment of said distribution nozzle 30, shown in detail in FIG. 8, the central pipe 31 of the distribution nozzle 30 comprises a substantially horizontal tray 33 in its profile, said tray 33 having an open end 34 under the end of the water outlet pipe 32. Any water from splashing is collected in said tray 33.

Said water flows to the area where the distribution nozzle 30 is pointing through the open end 34.

The upper casing 100 comprises a vertical pipe 102 which connects with the inlet pipe 101 and which also connects with the central pipe 31 of the distribution nozzle 30. In the embodiment of the invention being described, the distribution nozzle 30 has a labyrinth 35 in its upper part which comprises a circular channel coaxial with the central pipe 31. Said labyrinth 35 faces a labyrinth 104 which contains the upper casing 100. Said labyrinths 35 and 104 contribute to minimize the water leakage through the space between the vertical pipe 102 of the upper casing 100 and the central pipe 31 of the distribution nozzle 30.

As well as collecting the water from splashing, the tray 33 also collects the water which leaks through the space between the vertical pipe 102 and the central pipe 31.

Instead of using the labyrinths 35 and 104, sealing gaskets could also be used to minimize the gap between the distribution nozzle 30 and the upper casing 100. As can be seen in FIG. 1, water-tightness between other elements of the hydraulic distributor 1 is achieved via sealing gaskets.

Figure 9:
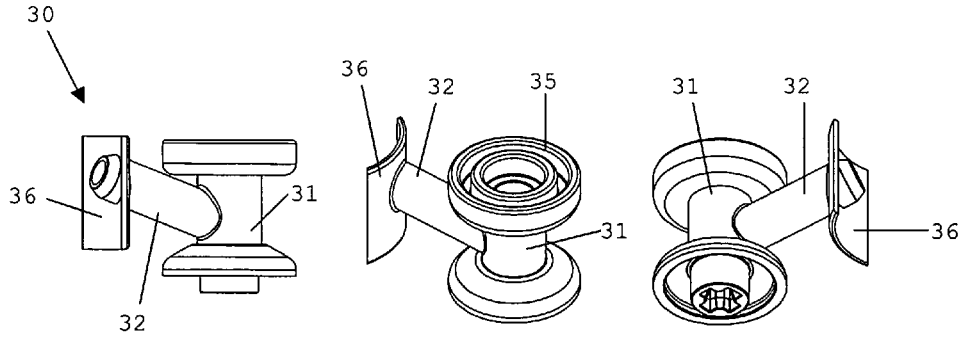
FIG. 9 shows a second embodiment of the distribution nozzle of the hydraulic distributor of the invention.

In a second embodiment of the distribution nozzle 30 of the invention, shown in FIG. 9, the water outlet pipe 32 of the distribution nozzle 30 comprises a plate 36 in its profile. The function of said plate 36 is to serve as a barrier, collecting the water from any splashing, said water flowing from said plate 36 to where the distribution nozzle 30 is pointing. Like the distribution nozzle 30 in the first embodiment, the distribution nozzle 30 in the second embodiment comprises a labyrinth 35 in its upper part.

The invention claimed is:

1. A hydraulic distributor for a washing machine comprising:

a rotating axle, water being directed from the mains to a plurality of compartments of the washing machine by means of the rotation of said rotating axle;

a hydraulic body comprising an emptying pipe, a draining pipe and an exit pipe for re-circulation;

a valve body housed inside said hydraulic body, wherein, by means of the rotation of the rotating axle, the valve body has a first position in which the flow from the emptying pipe is directed to the draining pipe, and a second position in which the flow from the emptying pipe is directed to the exit pipe for re-circulation; and a distribution nozzle which turns together with said rotating axle, said distribution nozzle transmitting the water coming from the mains to the corresponding washing machine compartment depending on an angular position of said distribution nozzle; wherein said valve body comprises a first wall that seals off the exit pipe for re-circulation when said valve body is in said first position and that seals off the draining pipe when said valve body is in said second position, and when said first wall of the valve body seals off the draining pipe, said distribution nozzle is positioned such that said distribution nozzle transmits any water coming from the mains to the draining pipe.

2. A hydraulic distributor according to claim 1, wherein the hydraulic body comprises a profile which is substantially cylindrical and coaxial with the rotating axle, the emptying pipe and the exit pipe being joined to said profile, and said first wall of the valve body resting on the inner surface of said profile.

3. A hydraulic distributor according to claim 2, wherein the valve body comprises a bushing which is attached to the rotating axle, said bushing being joined to the first wall by means of ribs, and said valve body also comprising a second wall, which is not a sealing wall, positioned symmetrically to the first wall with respect to the bushing, said bushing being joined to said second wall also by means of ribs.

4. A hydraulic distributor according to claim 3, wherein the first wall of the valve body is flexible.

5. A hydraulic distributor according to claim 1, wherein when the first wall of the valve body seals off the draining pipe, the distribution nozzle points towards an area with a hole in its lower part which communicates with the draining pipe, there being a valve in said hole, said valve sealing said hole when there is a flow of water through the draining pipe from the hydraulic body.

6. A hydraulic distributor according to claim 5, wherein said valve comprises a flap which pivots with respect to the edge of the hole which is closest to the hydraulic body so that, when there is a flow of water through the draining pipe from said hydraulic body, said flow pushes said flap, making said flap seal said hole.

7. A hydraulic distributor according to claim 1, wherein the distribution nozzle comprises a central water inlet pipe coaxial with the rotating axle and a water outlet pipe which extends radially from said central pipe.

8. A hydraulic distributor according to claim 7, wherein the central pipe of the distribution nozzle has a substantially horizontal tray in its profile, said tray having an open end under the end of the water outlet pipe.

9. A hydraulic distributor according to claim 7, wherein the water outlet pipe of the distribution nozzle has a plate in its profile.

10. A hydraulic distributor for a washing machine comprising:

a rotating axle, water being directed from the mains to a plurality of compartments of the washing machine by means of the rotation of said rotating axle;

a hydraulic body comprising an emptying pipe, a draining pipe and an exit pipe for re-circulation; and a valve body housed inside said hydraulic body, wherein, by means of the rotation of the rotating axle, said valve body has a first position in which the flow from said emptying pipe is directed to said draining pipe, and a second position in which the flow from said emptying pipe is directed to said exit pipe for re-circulation; wherein said valve body comprises a first wall that seals off said exit pipe for re-circulation when said valve body is in said first position, said first wall sealing off said draining pipe when said valve body is in said second position; and said hydraulic body comprises a profile which is substantially cylindrical and coaxial with the rotating axle, said emptying pipe and said exit pipe being joined to said profile, and said first wall of said valve body resting on an inner surface of said profile; wherein said valve body comprises a bushing which is attached to said rotating axle, said bushing being joined to said first wall by means of ribs, and said valve body also comprising a second wall which is not a sealing wall, positioned symmetrically to said first wall with respect to said bushing, said bushing being joined to said second wall also by means of ribs.

11. A hydraulic distributor according to claim 10, wherein said first wall of the valve body is flexible.

12. A hydraulic distributor according to claim 10, comprising a distribution nozzle which turns together with said rotating axle, said distribution nozzle transmitting the water coming from the mains to the corresponding washing machine compartment depending on its angular position.

13. A hydraulic distributor according to claim 12, wherein, when said first wall of said valve body seals off said draining pipe, said distribution nozzle is positioned such that said distribution nozzle transmits any water coming from the mains to the draining pipe.

14. A hydraulic distributor according to claim 13, wherein, when said first wall of the valve body seals off said draining pipe, said distribution nozzle points towards an area with a hole in its lower part which communicates with said draining pipe, there being a valve in said hole, said valve sealing said hole when there is a flow of water through said draining pipe from said hydraulic body.

15. A hydraulic distributor according to claim 14 wherein said valve comprises a flap which pivots with respect to the edge of the hole which is closest to the hydraulic body so that, when there is a flow of water through the draining pipe from said hydraulic body, said flow pushes said flap, making said flap seal said hole.

16. A hydraulic distributor according to claim 10, wherein the distribution nozzle comprises a central water inlet pipe coaxial with the rotating axle and a water outlet pipe which extends radially from said central pipe.

17. A hydraulic distributor according to claim 16, wherein the central pipe of the distribution nozzle has a substantially horizontal tray in its profile, said tray having an open end under the end of the water outlet pipe.

18. A hydraulic distributor according to claim 16, wherein the water outlet pipe of the distribution nozzle has a plate in its profile.

* * * * *